US005447826A

United States Patent [19]

Heremans et al.

[11] Patent Number: 5,447,826

[45] Date of Patent: Sep. 5, 1995

[54] PHOTOGRAPHIC SILVER HALIDE MATERIAL

[75] Inventors: Luc J. Heremans, Louvain; Rudi A. Goedeweeck, Rotselaar, both of Belgium

[73] Assignee: AGFA-Gevaert, N.V., Mortsel, Belgium

[21] Appl. No.: 232,332

[22] Filed: Apr. 18, 1994

Related U.S. Application Data

[63] Continuation of Ser. No. 926,326, Aug. 10, 1992, abandoned.

[30] Foreign Application Priority Data

Aug. 16, 1991 [EP] European Pat. Off. ..... 91202099

[51] Int. Cl.[6] ..... G03C 1/34

[52] U.S. Cl. ..... 430/405; 430/372; 430/523; 430/567; 430/569; 430/570; 430/603; 430/605; 430/966

[58] Field of Search ..... 430/372, 405, 569, 567, 430/603, 966, 523, 570, 605

[56] References Cited

U.S. PATENT DOCUMENTS

| | | | |
|---|---|---|---|
| 2,751,297 | 6/1956 | Hood et al. | 430/602 |
| 2,772,282 | 11/1956 | Allen et al. | 430/469 |
| 3,647,460 | 3/1972 | Hofman et al. | 430/428 |
| 4,806,462 | 2/1989 | Yamashita et al. | 430/605 |

*Primary Examiner*—Thorl Chea
*Attorney, Agent, or Firm*—Breiner & Breiner

[57] ABSTRACT

A photographic light-sensitive silver halide material is disclosed comprising a support and one or more hydrophylic colloid layers including at least one light-sensitive silver halide emulsion layer characterized in that in said emulsion layer is a gold and sulphur sensitized silver bromide or silver bromoiodide emulsion having cubic crystal habit and in that said emulsion and/or a hydrophylic colloid layer in water-permeable relationship therewith comprises a 3-pyrazolidinone compound.

12 Claims, No Drawings

PHOTOGRAPHIC SILVER HALIDE MATERIAL

This is a continuation of application Ser. No. 07/926,326 filed on Aug. 10, 1992, now abandoned.

FIELD OF THE INVENTION

The present invention relates to silver halide emulsions and their use in a photographic material.

BACKGROUND OF THE INVENTION

In X-ray photography efforts are directed to develop highly sensitive emulsions permitting minimum X-ray exposure for the patient, with a minimum fog level so that diagnosis is not disturbed owing to a lack in image quality. Moreover the properties of the film material should be stable even under severe atmospherical circumstances, e.g. high temperatures and high values of relative humidity, so that consistent results can be obtained from the viewpoint of sensitometry as well as image quality.

As a consequence an important aim in the photographic art in general is to develop emulsion making processes suitable for being used on an industrial scale which yield photographic materials with a maximum speed and a minimum overall fog even after long storage periods of said photographic materials.

On the other hand there is a general trend to enhance the speed of processing, especially in the field of radiography, and therefore interest has been focused on rapid access of radiographs, being vital in diagnosis, with development characteristics as independant as possible from development conditions.

It is generally known for one skilled in the art of photography that the sensitometric values and the image quality of a photographic light-sensitive material do not only depend on the characteristics of the emulsion but are determined also to a considerable extent by the processing conditions, in particular the type of developer selected and the degree of development.

As is generally known, the slope of the characteristic curve of a photographic material increases with increasing degree of development. However once a particular limit has been reached, the slope decreases with higher degrees of development as the fog caused by development rises considerably. The same phenomenon can also occur in short development times with more active developing baths having a minimum concentration of stabilizer.

In both cases fog may be suppressed by adding stabilizers to the emulsion layer. However it is not always evident to use whatever a stabilizer to get the expected effect on sensitometry. In addition, even when a stabilizer seems to deliver specific advantages, its use is not favoured, e.g. for ecological reasons, as it is the case for certain heavy metal salts with toxic properties.

Further it is generally known that the sensitometric properties of a photographic film and their dependence from the processing conditions, are determined to a large extent by the size, the crystal form and the crystal structure of the silver halide crystals, which in their turn are determined by the conditions of precipitation and subsequent ripening of the silver halide crystals.

Regular-shaped silver halide crystals useful in photography e.g. may be prepared by employing a technique known as balanced double jet precipitation wherein separate streams of silver nitrate and alkali metal halide are introduced into a stirred gelatin solution and the process is controlled to regulate the form of the resulting silver halide crystals.

By partially or fully controlling the conditions of temperature, concentrations, sequence of addition, and rates of addition it is possible to grow regular, crystalline and uniform particles with a cubic or octahedral form or any transition form.

Especially silver bromide and silver bromoiodide emulsions with cubic crystal habit as used in radiographic materials are known to have favourable development characteristics with respect to high sensitivity, but with the risk of high fog densities. Fog is intensified as the average diameter of the silver halide crystals increases.

If cubic crystals are showing reduction sensitization to a certain degree, leading to an increased sensitivity, it is generally known that the (100)-crystal faces are particularly sensitive to fog. On decreasing pAg during precipitation for increasing reduction sensitization an increase in fog results. The effects of the widely used 4-hydroxy-6-methyl-1,3,3a,7-tetraazaindene (TAI) and analogous nitrogen-containing compounds as well as e.g. 1-phenyl-5-mercaptotetrazole and the like as stabilizing agents are unsatisfactory for reducing this fog. Under the influence of humidity and heat the fog level may increase dramatically as is known from experience by the investigators. Hitherto only mercury salts could be selected to give an approximatively acceptable result in the most extreme storage conditions. However from an ecological point of view it is no longer acceptable to introduce these highly toxic products in photographic materials as care for the environment becomes more and more important.

OBJECTS OF THE INVENTION

It is an object of this invention to provide a photographic material comprising a silver halide emulsion with silver bromide or bromoiodide crystals which results in beneficial photographic properties in that the speed is high and a low fog level is preserved, the fog being substantially uneffected by the processing conditions.

It is a further object of this invention to provide photographic silver halide materials showing improved resistance to aging phenomena in unfavourable atmospheric circumstances.

Other objects will become apparent from the description hereinafter.

SUMMARY OF THE INVENTION

In accordance with the present invention the above objects are accomplished by providing a photographic light-sensitive silver halide material comprising a support and one or more hydrophylic colloid layers including at least one light-sensitive silver halide emulsion layer characterised in that said emulsion layer is a layer of a gold and sulphur sensitized silver bromide or silver bromoiodide emulsion having cubic crystal habit and in that said emulsion layer and/or a hydrophylic colloid layer in water-permeable relationship therewith comprises a 3-pyrazolidinone compound.

Particularly 1-p-carboxyphenyl-4,4'-dialkyl-3-pyrazolidones, the preparation of which has been described in U.S. Pat. No. 2,772,282 is preferred so that the material has an exceptionally good fog to speed relation. The suitability of these 3-pyrazolidinone compounds as fog preserving agents is unexpected especially as they are known as developing agents. They are preferably used in amounts comprised between 1 and 25 mmole per mole of silver nitrate per square meter.

DETAILED DESCRIPTION OF THE INVENTION

The parameter determining whether cubic or octahedral crystals are formed during the precipitation stage of the photographic emulsion making is the pAg of the solution.

The pAg of the solution may be regulated by any of the means known in the art of emulsion making, such as the electronic control apparatus and method disclosed in U.S. Pat. No. 3,821,002.

From the article "Der Einflu$\beta$ der Wachstumsbedingungen auf die Kristalltracht der Silberhalogenide" (the influene of Growth Conditions on the Crystalline Behaviour of Silver halides) von E. Moisar and E. Klein, Bunsengesellschaft für physikalische Chemie, Berichte 67 949–957 (1963) No 9.10., it is known that on allowing tetradecahedral crystals of a homodisperse silver bromide emulsion to grow by controlled addition of solutions of $AgNO_3$ and KBr, crystals of cubic form are obtained under conditions of low excess bromide concentration in the solution phase. With increasing excess of bromide, (111) surfaces are preferentially developed, and ultimately pure octahedral growth is observed.

The pAg-values yielding cubic, resp. octahedral crystals depend on the temperature. In Table I the pAg-neutrality values are set forth for various temperatures, as well as the values for the formation of resp. cubic and octahedral crystals at these temperatures, which are above the pAg-neutrality values. The last column gives the 'change-over pAg values', i.e. the pAg values below which cubic crystals and above which octahedral crystal formation is taking place. Around these pAg values the crystal formation balances between cubic and octahedral structure. Values for pAg-neutrality and those preferred for cubic or octahedral crystal formation are summarized in Table I.

TABLE I

| Temperature | pAg neutrality | pAg for cubic crystal formation | pAg for octahedral crystal formation | change-over pAg-value |
|---|---|---|---|---|
| 80° C. | 5.0 | 6.5 | 8.8 | 8.1 |
| 60° C. | 5.4 | 7.0 | 9.4 | 8.7 |
| 40° C. | 5.8 | 7.5 | 10.1 | 9.2 |
| 20° C. | 6.3 | 8.0 | 10.9 | 9.9 |

From the above table it is apparent that the cubic silver halide emulsions as used according to the present invention are precipitated generally under pAg conditions between 6.5 and 8.0.

The silver halide emulsions formed according to the present invention comprise silver bromide or silver bromoiodide. Preferred silver bromoiodide emulsions comprise at most 10 mole % of iodide. A preferred embodiment of making the emulsions used according to the present invention involves the preparation of high-sensitive silver bromide or silver bromoiodide emulsions e.g. X-ray emulsions, by precipitation under balanced double jet conditions. The average grain-size of the silver halide emulsions made according to the present invention may vary between wide limits and depends on the intended use for the emulsion. Fine grain as well as coarse-grain emulsions, with an average crystal diameter between 0.1 and 2 $\mu$m, preferably below 1 $\mu$m, can be made according to the present invention, depending on the use of grain-growth restrainers or accelerators, the flow rate and concentration of the solutions, the temperature, pAg etc.. Particle size of silver halide grains can be determined using conventional techniques e.g. as described by Trivelli and M. Smith, The Photographic Journal, vol. 69, 1939, p. 330–338, Loveland "ASTM symposium on light microscopy" 1953, p. 94–122 and Mees and Jones "The Theory of the photographic process" (1977), Chapter II.

Monodispersed as well as heterodispersed emulsions can be made according to the present invention, depending on the initial conditions during precipitation, monodispersed emulsions being, however, preferred. Monodispersed emulsions in contrast to heterodispersed emulsions have been characterized in the art as emulsions of which at least 95% by weight or number of the grains have a diameter which is within about 40%, preferably within about 30% of the mean grain-diameter and more preferably within about 10% to 20%.

Silver halide grains having a narrow grain-size distribution can be obtained by controlling the conditions at which the silver halide grains are prepared using a double jet procedure. In such a procedure, the silver halide grains are prepared by simultaneously running an aqueous solution of a water-soluble silver salt for example, silver nitrate, and watersoluble halide, for example, potassium bromide, into a rapidly agitated aqueous solution of a silver halide peptizer, preferably gelatin, a gelatin derivative or some other protein peptizer. Even colloidal silica may be used as a protective colloid as has been described in EP 0392092.

In a preferred embodiment the rates of addition of the silver nitrate and halide salt solutions is steadily increased in such a way that no renucleation appears in the reaction vessel. This procedure is especially recommended, not only to save time but also to avoid physical ripening of the silver halide crystals during precipitation, the so-called Ostwald ripening phenomenon, which gives rise to the broadening of the silver halide crystal distribution.

Once the grains have reached their ultimate size and shape, the emulsions are generally washed to remove the by-products of grain-formation and grain-growth.

The emulsions may be chill-set, shredded and washed by leaching in cold water, or they may be washed by coagulation.

In accordance with the present invention, the emulsions are preferably washed by acid-coagulation techniques using acid-coagulable gelatin derivatives or anionic polymeric compounds or, when precipitation occurred in silica medium, by certain polymers capable of forming hydrogen bridges with silica, in an amount sufficient to form coagulable aggregates with the silica particles as has been described in EP Application 91201426.3.

Coagulation techniques using acid-coagulable gelatin derivatives have been described e.g. in U.S. Pat. Nos. 2,614,928, 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the U.S. patents referred to above. Particularly suitable are phthaloyl gelatin and N-phenylcarbamoyl gelatin.

It is also possible to wash the emulsion by coagulation techniques using anionic polymeric compounds. Such techniques have been described e.g. in German Patent 1,085,422. Particularly suitable anionic polymeric compounds are polystyrene sulphonic acid and sulphonated copolymers of styrene. The anionic polymers can be added to the gelatin solution before precipitation of the silver halide grains or after the stage of emulsification. They are preferably added after the grains have reached their ultimate size and shape, i.e. just before washing. It is also possible to use anionic polymers in combination with acid-coagulable gelatin derivatives as described in the published German Patent Specification No. 2,337,172 (DOS). It is preferred to use low-molecular weight polystyrene sulphonic acid having a molecular weight of at most 30,000. The polystyrene sulphonic acid can be added to the gelatin solution from aqueous solutions preferably comprising from 5 to 20% by weight of polystyrene sulphonic acid. The amounts used suffice to impart coagulation properties to the emulsion and can easily be determined by those skilled in the art.

After the precipitation stage, the silver halide emulsion comprising acid-coagulable gelatin derivative or anionic polymer is acidified e.g. by means of dilute sulphuric acid, citric acid, acetic acid, etc. so as to effect coagulation. Coagulation generally occurs at a pH value comprised between 3 and 4. The coagulum formed may be removed from the liquid by any suitable means, for example the supernatant liquid is decanted or removed by means of a siphon, where upon the coagulum is washed out once or several times.

Washing of the coagulum may occur by rinsing with mere cold water. However, the first wash water is preferably acidified to lower the pH of the water to the pH of the coagulation point. Anionic polymer e.g. polystyrene sulphonic acid may be added to the wash water even when an acid coagulable gelatin derivative has been used e.g. as described in published German Patent Specification (DOS) 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as is necessary.

After the washing operation, the coagulum is redispersed to form a photographic emulsion suitable for the subsequent finishing and coating operations by treating, preferably at a temperature within the range of 35° to 70° C., with the required quantity of water, normal gelatin and, if necessary, alkali for a time sufficient to effect a complete redispersal of the coagulum.

Instead or in addition to normal gelatin, which is preferably used, other known photographic hydrophilic colloids can also be used for redispersion e.g. a gelatin derivative as referred to above, albumin, agar-agar, sodium alginate, hydrolysed cellulose esters, polyvinyl alcohol, hydrophilic polyvinyl copolymers, colloidal silica etc.

The light-sensitive silver bromide or silver bromoiodide emulsions are chemically sensitized with a sulphur and gold sensitizer. This can be done as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature sulphur sensitization can be carried out by effecting the ripening in the presence of small amounts of compounds containing sulphur e.g. thiosulphate, thiocyanate, thioureas, sulphites, mercapto compounds, and rhodamines. Gold sensitization occurs by means of gold compounds. In addition small amounts of compounds of Ir, Rh, Ru, Pb, Cd, Hg, Tl, Pd or Pt can be used. The emulsions can be sensitized in addition by means of reductors e.g. tin compounds as described in GB-A 789,823, amines, hydrazine derivatives, formamidine-sulphinic acids, and silane compounds.

The light-sensitive silver halide emulsions can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products.

In addition to the 3-pyraolidinone stabilizing compounds used in accordance with the present invention other compounds for preventing the formation of fog or stabilizing the photographic characteristics during the production or storage of photographic elements or during the photographic treatment thereof may be supplementary added. Examples of such stabilizers are heterocyclic nitrogen-containing stabilizing compounds as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide and other disulfide derivatives, which are giving an unsatisfactory result if added as the sole stabilizing agent. Even the well-known stabilizing effect on cubic crystals of 4-hydroxy-6-methyl-1,3,3a,7-tetraazaindene (TAI) as described by H. Takiguchi in J. Imag. Sci., 32(1),1988, p.20, doesn't work satisfactorily for cubic silver bromide and silver bromoiodide crystals. On the other hand the already mentioned mercury salts and other metal-salts that can be used as fog-inhibiting compounds such as cadmium salts and related compounds described in Research Disclosure N° 17643 (1978), Chapter VI, should be evoided for reasons of ecology.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methylol-dimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805 - 4,038,075 -4,292,400.

The photographic element of the present invention may further comprise various other additives such as e.g. compounds improving the dimensional stability of the photographic element, UV-absorbers, spacing agents, hardeners, plasticizers, antistatic agents etc. . .

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins , and styrenes, or copolymers of the above with acrylic acids, methacrylic acids, Alpha-Beta-unsaturated dicarboxylic acids, hydroxyalkyl (meth)acrylates, sulphoalkyl (meth-)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 um. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic element can comprise an antistatic layer e.g. to avoid static discharges during coating, processing and other handlings of the material. Such antistatic layer can be an outermost coating or stratum of one or more antistatic agents or a coating applied directly to the film support or other support and overcoated with a barrier or gelatin layer. Antistatic compounds suitable for use in such layers are e.g. vanadium pentoxide sols, tin oxide sols or conductive polymers such as polyethylene oxides and the like.

The following examples illustrate the present invention.

EXAMPLES 1 TO 10

A fully chemically sensitized fast monodisperse negative bromoiodide emulsion of 1 mole percent iodide content was prepared in the following manner.

50 g of gelatin were added to 1.000 ml of demineralised water containing 11 g of methionin as a growth accelerator under constant stirring at 400 rpm; the mixture was held for 30 minutes at room temperature and heated up to 60° C. This temperature was kept constant during the entire precipitation process.

Before starting the precipitation a few drops of a diluted solution of potassium bromide were added so as to bring the pAg of the solution at a value of 7.9.

30 ml of 2.94 N $AgNO_3$ (3% of the total amount of $AgNO_3$) were added under the following conditions: during the first five minutes the flow of $AgNO_3$ was kept constant at 6 ml/min and a sufficient flow of a mixture of 99% KBr and 1% KI was added so as to keep the pAg constant at 7.9. During the following 51 minutes the flow of $AgNO_3$ was steadily increased from 6 ml/min up to 32 ml/min whereas the pAg was kept constant at 7.9 by regulating the flow of the mixture of KBr and KI, allowing 970 ml of $AgNO_3$ to be added. The latter was realised by means of an automated electronic control apparatus for silver halide preparation disclosed by Claes and Peelaers in Photographische Korrespondenz 102, Band Nr. 10/1967, p. 162.

After five minutes the pH of the emulsion was reduced from 5.8 to 3.5 by adding a sufficient quantity of 6N sulfuric acid.

Hereupon the conventional photographic processes such as washing and redispersing were applied to the emulsion: pAg was bypassed to a value of 8.4 at 45° C., pH to a value of 5.8. The obtained silver halide crystals have an average diameter of 0.72 μm.

The emulsion was further chemically sensitized for a period of 3 hours at 45° C. in the presence of p-toluene thiosulphonate, sodium thiosulphate and gold(III)chloride as noble-metal sensitizer.

A series of photographic material samples were made by coating the emulsion on polyethylene terephthalate together with a composition for forming a protective gelatin layer. The emulsion layers were coated at a ratio of 7 g/m$^2$ expressed as the equivalent amount of $AgNO_3$. The amount of gelatin per square meter in the emulsion layers was 3.3 g, whereas in the protective layers it was 1.1 g.

Differences between the coated samples are concerning the amount of 1-p-carboxyphenyl-4,4'-dimethyl-3-pyrazolidine-1-one that has been added: in examples 2 to 4 an amount of respectively 100; 200; and 300 mg/m$^2$ was added to the protective gelatin coating.

As a comparison sample (example 5) no compound was added. In another comparative sample (example 1) a mercury salt ($Hg(CN)_2$ in an amount of 0.012 mg/m$^2$) was added to the emulsion layer. For all samples TAI was always incorporated as an emulsion stabilizer to the coating solutions in an amount of 35 mg/m$^2$.

Separate strips of the samples were subsequently exposed through a grey continuous wedge to white light in a Herrnfeld Sensitometer and developed for 12 seconds in a developing bath of the following composition:

| | |
|---|---|
| hydroquinone | 15 g |
| 1-phenyl-pyrazolidine-1-one | 0.9 g |
| acetic acid 96% | 9.125 ml |
| potassium carbonate | 16 g |
| potassiummetabisulfite | 41.75 g |
| potassium hydroxyde | 39 ml |
| glutardialdehyde | 15 ml |
| 1-phenyl-5-mercaptotetrazole | 10 mg |
| demineralized water up to | 1000 ml |

Starter solution to be added:

| | |
|---|---|
| acetic acid 96% | 2.625 ml |
| KBr | 4 ml |
| KI | 0.01 ml |
| demineralized water up to | 40 ml |

Hereupon, the developed photographic strips were fixed in a conventional fixing bath comprising e.g. sodium thiosulfate and potassium metabisulfite, and then rinsed in water and allowed to dry.

Sensitometric properties of these film strips are indicated in Table II. In this table the values figuring in the different columns have the following meaning: the values set forth in the first three columns show the sensitometric results in terms of fog, speed, and gradation of the photographic strips prepared as set forth above and developed in the developing bath of the composition set forth above during an overall developing time of 12 seconds.

The values for the speed are absolute values corresponding to density 1 above fog, expressed in log Ixt, a lower value indicating that the material is more sensitive (a difference in log Ixt of −0.30 means a doubling of the speed). The values given for gamma are the values of gradation measured from the characteristic curve over a density range of 0.80 starting from a density value of 0.80 to 1.60 above fog.

The last three columns of Table II show the difference in speed, fog and gradation after preservation of the strips in well-determined circumstances of temperature (57° C.) and relative humidity (34% RH) for 72 hours before being exposed to light and developed in the developing bath of the composition set forth above in the same circumstances as the fresh strips.

TABLE II

| | | | | Difference in | | |
|---|---|---|---|---|---|---|
| Example | Fog | Speed | Gradation | fog | speed | gradation |
| comp 1 | 0.048 | 200 | 3.09 | +0.019 | +0.04 | −0.010 |
| 2 | 0.012 | 200 | 3.38 | +0.008 | +0.02 | −0.059 |
| 3 | 0.013 | 201 | 3.43 | +0.006 | +0.03 | −0.074 |
| 4 | 0.011 | 200 | 3.57 | +0.007 | +0.06 | −0.095 |
| comp 5 | 0.049 | 193 | 3.02 | +0.114 | +0.30 | −0.062 |

It is clear from comparative example 5 that the addition of a stabilizing compound is necessary. Comparative example 1 shows that a mercury salt is giving rise to better preservation results, but that the best results are obtained with 1-p-carboxyphenyl-4,4'-dimethyl-3-pyrazolidine-1-one in an amount of several hundreds of milligrams per square meter, being an amount that is not very critical.

We claim:

1. A photographic light-sensitive silver halide material comprising a support and one or more hydrophylic colloid layers including at least one light-sensitive silver halide emulsion layer wherein said silver halide emulsion layer is a layer of a gold and sulphur sensitized silver bromide or silver bromoiodide emulsion having cubic crystal habit and 1-paracarboxy-phenyl, 4,4',dimethyl-3-pyrazolidine-1-one is present in said silver halide emulsion layer, or in a hydrophylic colloid layer in water-permeable relationship with said silver halide emulsion layer or in both said silver halide emulsion layer and in a hydrophilic colloid layer in permeable relationship with said silver halide emulsion layer.

2. A photographic material according to claim 1 wherein the said silver bromide or silver bromoiodide emulsion is monodispersed.

3. A photographic material according to claim 1 wherein the 1-paracarboxy-phenyl, 4,4',dimethyl-3-pyrazolidine-1-one is present in a protective layer coated over the silver halide emulsion layer.

4. A photographic material according to claim 1 wherein the 1-paracarboxy-phenyl, 4,4',dimethyl-3-pyrazolidine-1-one is present in an amount of 1 to 25 mmole per mole of silver halide of the emulsion.

5. A photographic material according to claim 1 wherein said silver halide emulsion is a spectrally sensitized silver halide emulsion.

6. A photographic material according to claim 1 wherein the photographic material is an X-ray material.

7. Method of forming an image comprising imagewise exposing a photographic light-sensitive silver halide material comprising a support and one or more hydrophilic colloid layers including at least one light-sensitive silver halide emulsion layer wherein said silver halide emulsion layer is a layer of a gold and sulphur sensitized silver bromide or silver bromoiodide emulsion having cubic crystal habit and 1-paracarboxy-phenyl, 4,4',dimethyl-3-pyrazolidine-1-one is present in said silver halide emulsion layer, or in a hydrophilic colloid layer in water-permeable relationship with said silver halide emulsion layer or in both said silver halide emulsion layer and in a hydrophilic colloid layer in permeable relationship with said silver halide emulsion layer and developing said material in a developer comprising hydroquinone and phenidone.

8. A method according to claim 7 wherein the said silver bromide or silver bromoiodide emulsion is monodispersed.

9. A method according to claim 7 wherein said silver halide emulsion is a spectrally sensitized silver halide emulsion.

10. A method according to claim 7 wherein the 1-paracarboxy-phenyl, 4,4',dimethyl-3-pyrazolidine-1-one is present in an amount of 1 to 25 mmole per mole of silver halide of the emulsion.

11. A method according to claim 7 wherein the photographic material is an X-ray material.

12. A method according to claim 7 wherein the 1-paracarboxyl-phenyl, 4,4',dimethyl-3-pyrazolidine-1-one is present in a protective layer coated over the silver halide emulsion layer.

* * * * *